US005413335A

United States Patent [19]

Braun

[11] Patent Number: 5,413,335

[45] Date of Patent: May 9, 1995

[54] INTERCHANGEABLE RACQUET COMPONENT SYSTEM

[76] Inventor: Joseph M. Braun, 1103 Harrison Blvd., Boise, Id. 83702

[21] Appl. No.: 222,084

[22] Filed: Mar. 31, 1994

[51] Int. Cl.[6] ..... A63B 49/02

[52] U.S. Cl. ..... 273/73 L

[58] Field of Search ..... 273/73 R, 73 C, 73 D, 273/73 L

[56] References Cited

U.S. PATENT DOCUMENTS

| | | | |
|---|---|---|---|
| 240,183 | 4/1881 | Richardson | 273/73 L |
| 4,185,822 | 1/1980 | Li | 273/73 L X |
| 4,357,012 | 11/1982 | Maynard | 273/73 L |
| 4,772,021 | 9/1988 | Maynard | 273/73 L X |
| 4,880,234 | 11/1989 | Salisbury | 273/73 L |
| 4,983,242 | 1/1991 | Reed | 156/172 |

FOREIGN PATENT DOCUMENTS

| | | | |
|---|---|---|---|
| 151916 | 6/1953 | Australia | 273/73 L |
| 2373302 | 8/1978 | France | 273/73 L |
| 2581317 | 11/1986 | France | 273/73 L |

*Primary Examiner*—William E. Stoll
*Attorney, Agent, or Firm*—Korfanta & Dunbar

[57] ABSTRACT

A racquet system having a frame, an interchangeable string head, and optionally, a damper membrane to reduce vibration. The hoop-shaped frame head inner surface contains a channel, contoured to accept the outside surface of the damper membrane. The damper membrane is shaped to interfit between the string head and frame head. The string head possesses string holes for forming a high tension grid of strings. The string head is shaped to interfit within the frame head. The string head and damper membrane are locked in place in the frame head.

7 Claims, 4 Drawing Sheets

INTERCHANGEABLE RACQUET COMPONENT SYSTEM

BACKGROUND OF THE INVENTION

1. Technical Field

The present invention is in the field of sports racquets, especially tennis racquets, and more specifically relates to a new racquet component system with interchangeable components, which address performance characteristics.

2. Background

In the field of tennis racquet design, much of the evolution in the design of racquets has been motivated concomitantly by a search for a larger sweet spot in the racquet and improved matching between the racquet specifications and an individual player's needs.

The sweet spot is defined as the most responsive part of the tennis racquet face. The sweet spot of the racquet provides improved power and control of racquet and ball, and transfers less vibration and shock to the racquet. From the player's perspective, the sweet spot is the area of the racquet face which gives the player the most power and control and the most solid hit. It is also the place on the racquet where the player feels the least vibration or shock. From a technical perspective, the sweet spot is the area of the racquet that is defined as having at least a 40% return rate. That is, for example, if a ball travels into the racquet at 100 miles per hour, it will leave the strings traveling at least 40 miles per hour.

A number of changes have been made in racquet design in the prior art in pursuit of a larger sweet spot and greater dovetailing between the racquet specifications and individual player profiles. For example, the materials used to construct the racquet have gone from wood to metal, aluminum, graphite and various other combinations of synthetic and composite materials. The shape of the head of the racquet frame has been changed and made larger to increase the likelihood of ball contact and increase the area of the sweet spot. The larger head size of the racquet also increases the power of the racquet.

The new materials used to make the racquets are much lighter and stronger, giving the player more power and control but also causing the racquet to transfer more vibration to the player because of the lightness of the racquet. One response to this increase in vibration transferred to the player from the racquet has been to make the racquet stiffer. Another response to the problem of transferred vibration is seen in U.S. Pat. No. 4,983,242, Reed, which shows a tennis racquet that is formed with a damping sleeve to reduce the vibrations produced by the lighter racquet frames.

In addition to changes in the materials and the racquet head size, racquet design changes have also incorporated greater stiffness into the racquet. The increased stiffness in the racquet results in greater energy being returned to the ball, and again decreased vibration perceived by the player.

What is still needed is a racquet which provides a quick and convenient means for custom tailoring a match between an individual player's needs and the racquet, allowing the player to change the performance characteristics of the racquet along with the "feel" of the racquet, for example, to increase the player's perception of the size of the sweet spot.

What is also needed is a racquet component system that allows quick interchangeability of string heads.

String heads can be interchanged to allow rapid repair of damaged strings during a game or match or at any time that it is not possible or appropriate to repair the damaged strings. Interchangeable string heads also allow for the rapid and convenient substitution of different string types and varying string tensions into the racquet. String heads may also be interchanged to allow the introduction of a different weight of string head into the racquet system.

What is also needed is a racquet component system that allows quick and improved means for changing any component of the racquet component system to change the performance characteristics of the racquet under a long term or permanent change in conditions or the player's ability. For example, interchanging the racquet head or racquet frame to alter the control or power characteristics of the racquet or the damping and shock absorbing features of the racquet in response to player skill or to player injury.

What is also needed is a racquet component system that allows quick interchangeability of racquet components to implement changing the performance characteristics of the racquet in response to changing conditions. These conditions encompass changes in either playing conditions, player conditions, racquet conditions or any combination of the three. Changes in the player's conditions include, for example, improvements in the player's skill and changes in the player's ability due to temporary injuries the player may sustain. Changes in playing conditions that a player can encounter include changes in the environment, such as the weather, or different court surfaces as well as varying styles of the player or the player's opponents.

It is, therefore, an object of the present invention to supply a racquet component system with interchangeable components, allowing better ability to control the "feel" of the racquet and a quick and convenient means for custom tailoring a match between an individual player and the racquet performance characteristics.

It is a further object of this invention to provide a racquet that allows quick interchangeability of string heads. String heads can be interchanged to allow rapid repair of damaged strings during a game or match or at any time that it is not possible or appropriate to repair the damaged strings. Interchangeable string heads also allow for the rapid and convenient substitution of different string types and varying string tensions into the racquet. String heads may also be interchanged to allow the introduction of a different weight of string head into the racquet system.

It is a further object of this invention to provide a racquet that allows quick and improved means for changing any component or any combination of the components of the racquet system, to change the performance characteristics of the racquet under constant conditions. For example, interchanging the racquet head or racquet frame to alter the control or power characteristics of the racquet or the damping and shock absorbing features of the racquet.

It is a further object of this invention to provide a racquet that allows quick interchangeability of racquet components to implement changing the performance characteristics of the racquet in response to changing conditions. These conditions encompass changes in racquet conditions, playing conditions, player conditions, or any combination of the three. Changes in the player's conditions include, for example, improvements in the player's skill and changes in the player's ability due to injuries. Changes in playing conditions that a player can encounter include changes in the environment, such as the weather, or different court surfaces as well as varying styles of the player's opponents, changes in racquet conditions would include, for example, changing the weight of the string head to change the damping characteristics of the racquet system or to change the overall weight of the racquet to effect a change of performance. An example of changing the overall weight of the racquet to effect a change of performance would be making the racquet light for playing close to the net versus making the racquet heavier for playing the baseline.

DISCLOSURE OF INVENTION

The invention is an interchangeable racquet component system. The racquet component system generally consists of a frame, with a generally hoop shaped head, a string head, a damper membrane, and a securing means.

The string head possesses string holes spaced around its circumference to facilitate forming a grid of high-tension string within the racquet head. The string head is correspondingly shaped to interfit within the frame head and possesses a plurality of securing means apertures spaced to correspond to the frame head depressions.

A damper member may be provided between the string head and the racquet frame to provide an adjustable shock absorbing feature. The damper membrane's outside surface possesses an elevated strip and a plurality of projections shaped with complimentary symmetry to the channel of the frame head; allowing interfitting between the frame head and string head. The damper membrane projections correspond to the string head apertures and the frame head depressions. The inside surface of the damper membrane possesses depressions located opposite projections on the outside surface.

The inner surface of the frame head contains a channel contoured to receive the outside surface of the damper membrane. The channel contains a plurality of securing means depressions, spaced around the circumference of the frame head inner surface. The depressions of the frame head are sized to securely accept a securing means.

The string head and damper membrane are interfitted and locked in place within the frame head by the securing means. Optionally the string head can be shaped to interfit within the frame head without the inclusion of the damper membrane.

In use the three elements are aligned such that the depressions of the frame head which receive the securing means are aligned with projections of the damper membrane and the securing means receiving apertures of string head. The damper membrane can be made out of various shock absorbing or resilient materials, to vary the performance characteristics desired by the player.

The damper membrane and string head are both removable and replaceable, allowing better control of the player's perception of the sweet spot and matching between the racquet characteristics and individual player needs. The high damping characteristics of this invention increase the player's perception of an enlarged sweet spot.

The components of the racquet component system, that is the frame, string head and damper membrane, can be made from a variety of materials. In addition to options in construction materials used in the racquet component system the string head can be custom strung with different string types and different tensions that support the player's needs. These options in materials and interchanging components provide the player with a racquet component system that allows the player to change string heads rapidly to allow replacement of damaged strings, introduce different string types and tensions, and to change the weight of the string head within the racquet. This racquet component system improves the ability of the player to custom tailor the equipment to the player's individual needs and goals.

The interchangeability of the racquet components also allows the player to change the performance properties of the racquet under long term and constant conditions. The player can interchange the racquet components to manipulate, for example, the control characteristics, the power characteristics or the shock absorption characteristics of the racquet system under constant playing conditions.

The interchangeability of the racquet components provides additional advantages by allowing the player the flexibility to change the properties of the racquet in response to changing conditions. These changes may be changes in racquet conditions, playing conditions or in the player's conditions or any combination of the three sets of changes. Changes in playing conditions that a player may encounter include, for example, changes in the environment, such as the weather or different court surfaces, as well as varying styles of the player's opponents. Changes in the player's conditions include improvement in the player's skills and changes in the player's ability due to temporary injuries the player may experience or a hiatus from playing the game. Changes in the racquet conditions would include, for example, changing the weight of the string head to change the damping characteristics of the racquet system or to change the overall weight of the racquet to effect a change of performance. An example of changing the overall weight of the racquet to effect a change of performance would be making the racquet light for playing close to the net versus making the racquet heavier for playing the baseline.

BEST MODE FOR CARRYING OUT INVENTION

Figure 1:
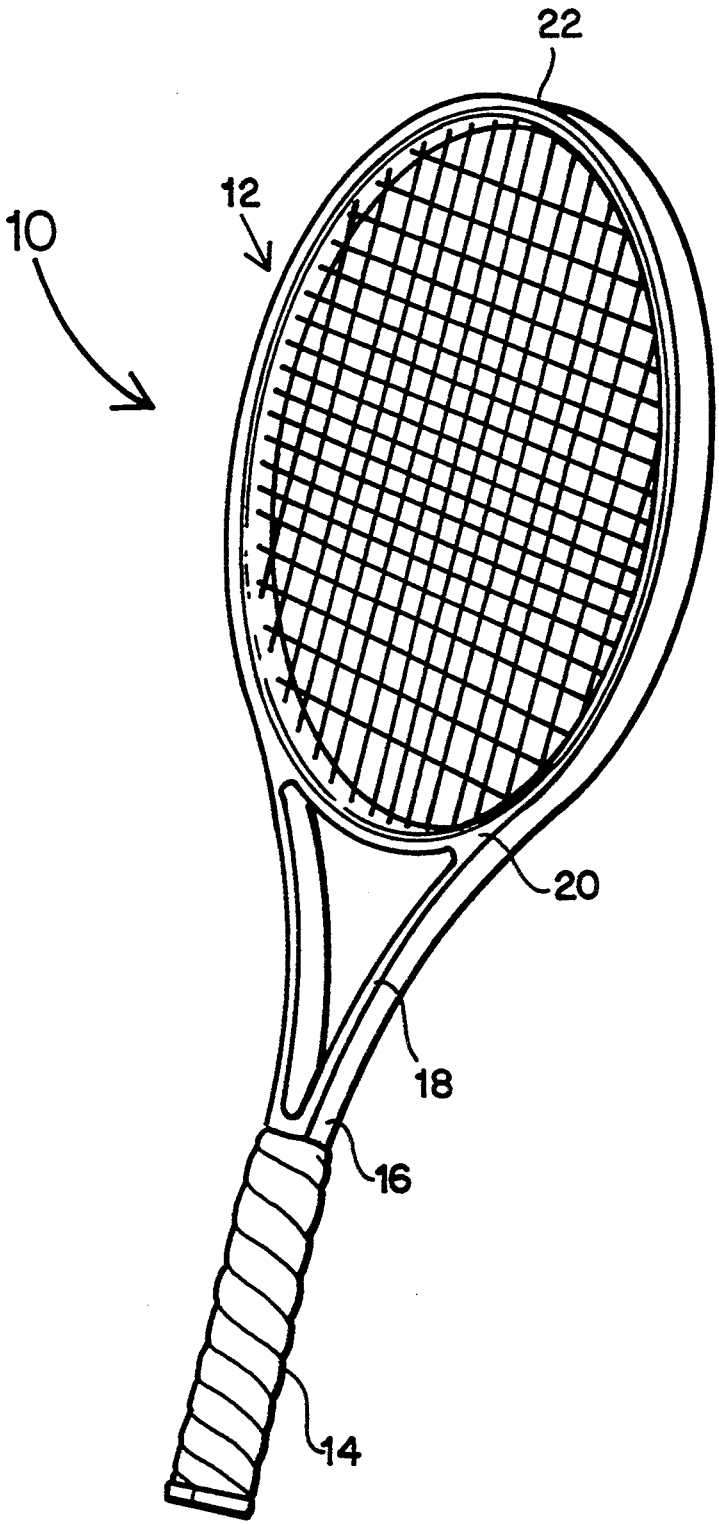
FIG. 1 is a perspective representational view of the preferred embodiment of the present invention.

Referring now to FIGS. 1 through 5, a shock absorbing racquet component system is illustrated in accordance with the principals of the present invention. Racquet 10 generally is comprised of a frame 12, damper membrane 30, and string head 42 in a manner best seen in FIG. 1. Frame 12 is comprised of handle 14, and hoop-shaped frame head 22 as can be seen in FIG. 1.

Figure 2:
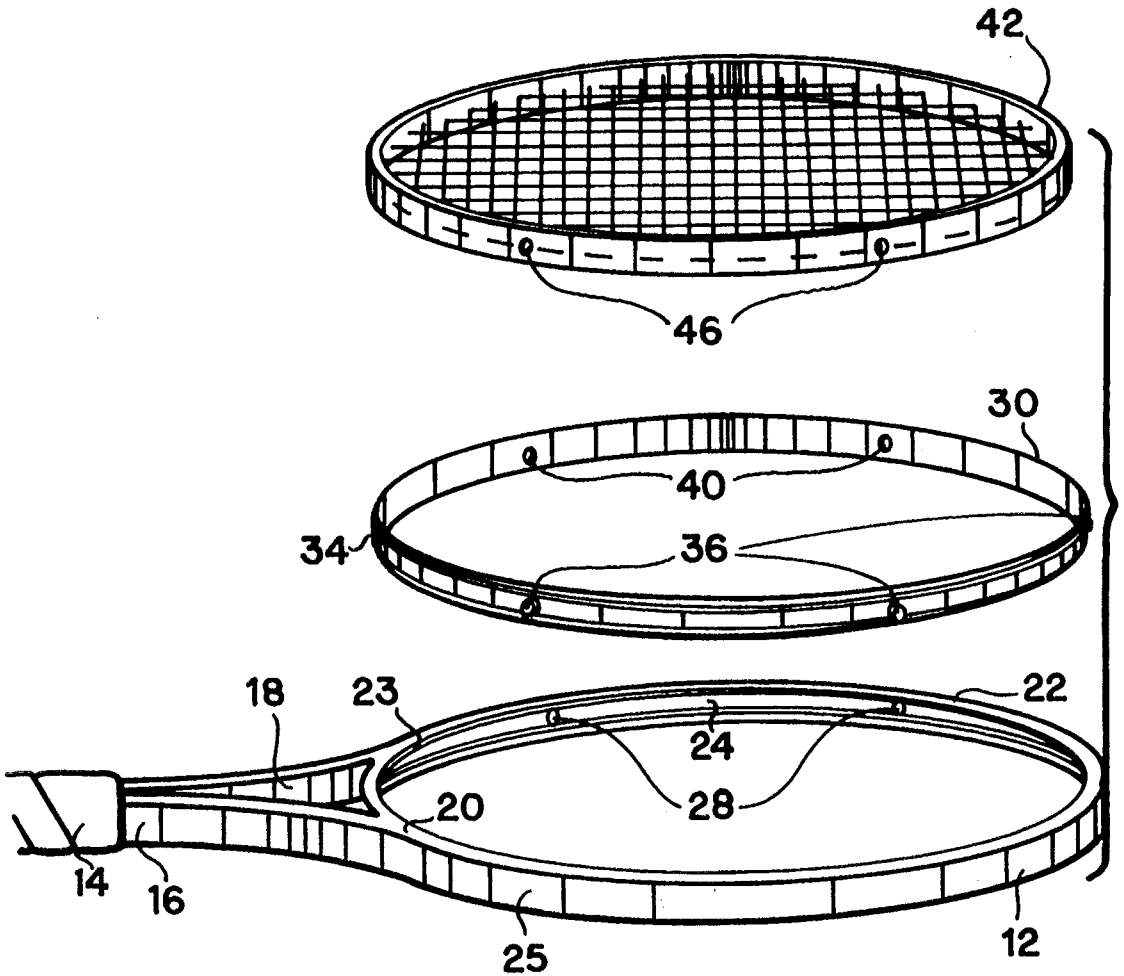
FIG. 2 is a side view of the three separate components of the preferred embodiment of the present invention.
Figure 3:
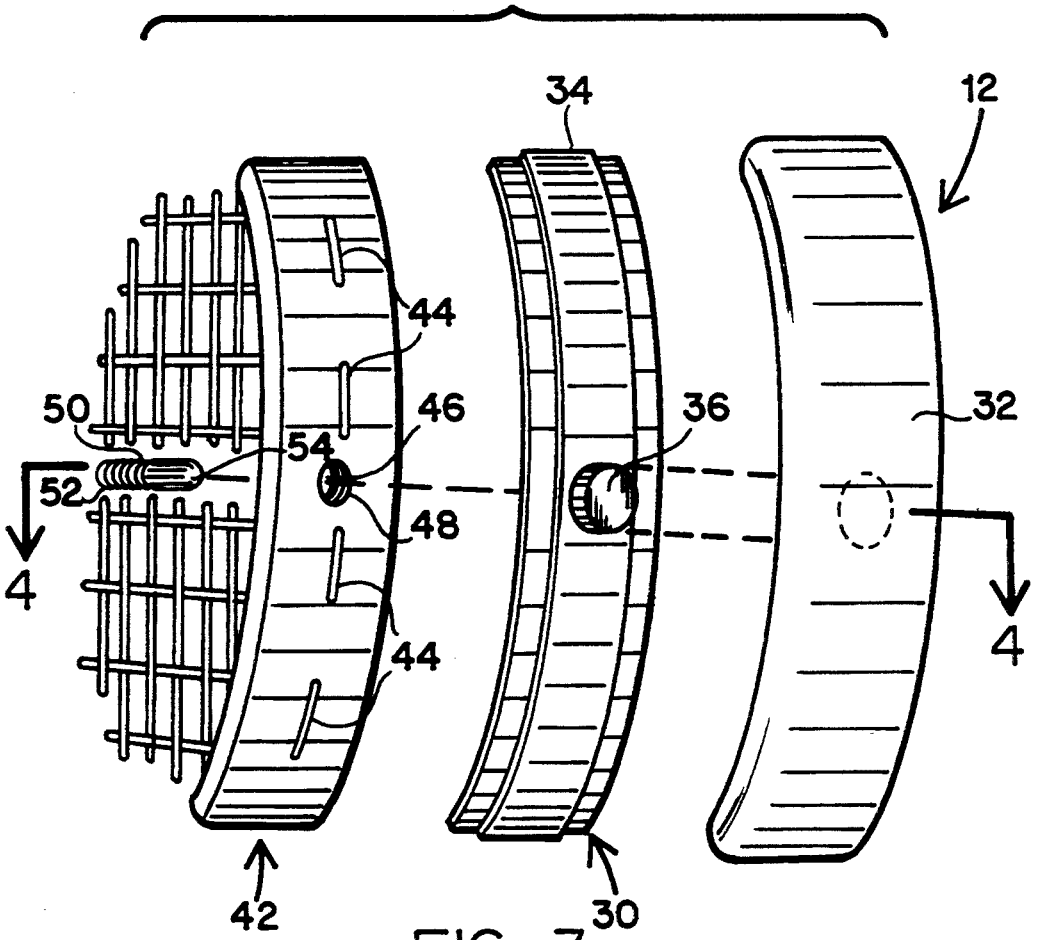
FIG. 3 is a detailed view of the fitting of the three parts of the preferred embodiment of the present invention.
Figure 4:
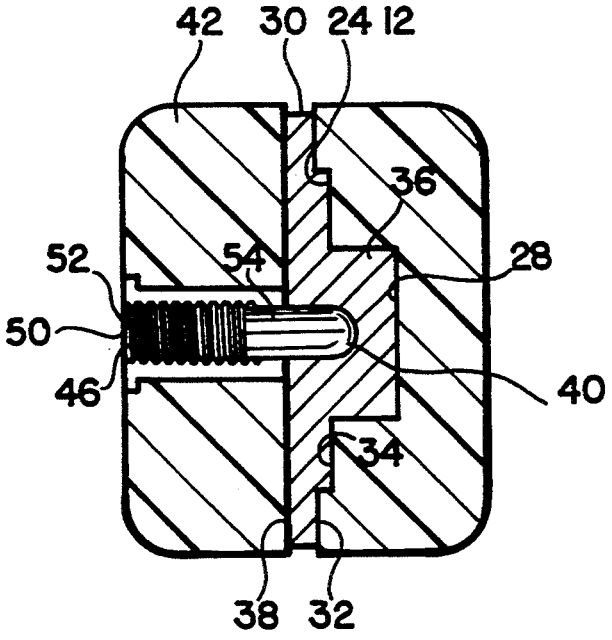
FIG. 4 is a detailed view of the securing means for the preferred embodiment.
Figure 5:
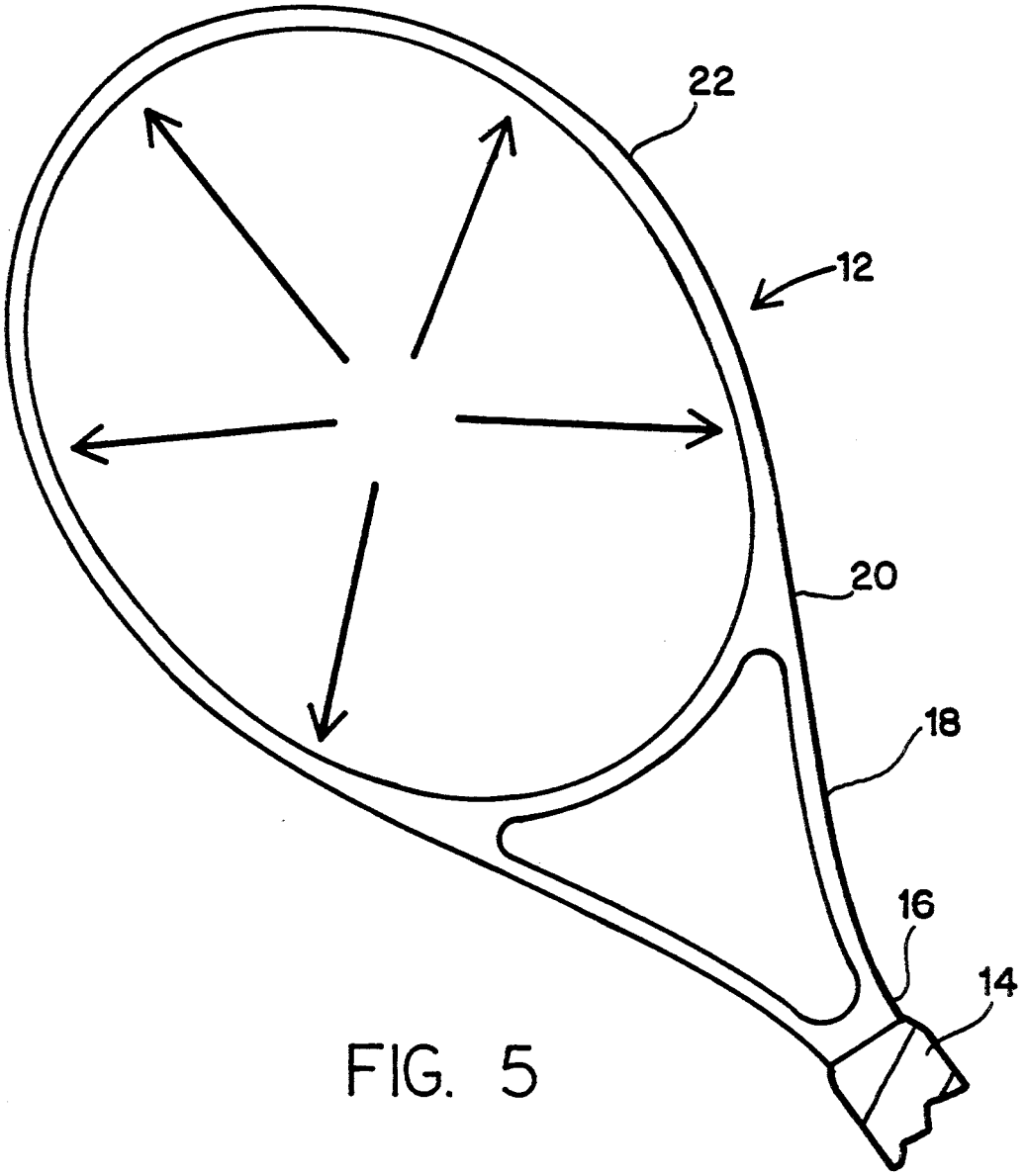
FIG. 5 is a schematic of the preferred embodiment of the invention showing the sites for the securing means device.

Frame head 22 has an inner surface 23 and outer surface 25. Inner surface 23 contains channel 24 which is contoured to receive outside surface 32 of damper membrane 30, as best seen in FIGS. 2 and 4. Additionally, channel 24 contains a plurality of depressions 28, for receiving securing means 50. Depressions 28 are spaced approximately equidistant around the circumference of inner surface 23 of frame head 22, as can be seen in FIGS. 2, 3 and 5.

String head 42 possesses string holes 44 spaced around its circumference for forming a grid of high tension strings. String head 42 is approximately hoop shaped and is correspondingly shaped to interfit frame head 22. Additionally, string head 42 possesses a plurality of apertures 46 for receiving a securing means to hold string head 42 in position in frame head 22. Apertures 46 are spaced approximately equidistant around the circumference of string head 42 to correspond to depressions 28 of frame head 22, as can be seen in FIGS. 2, 3 and 5. Aperture 46 in the preferred embodiment possesses threads 48 for receiving and securing a plurality of threaded securing means pins 50, as can best be seen in FIG. 4.

Damper membrane 30 has outside surface 32 and inside surface 38, as can be seen in FIG. 2. Outside surface 32 possesses elevated strip 34 and a plurality of projections 36. Elevated strip 34 is shaped with complimentary symmetry to channel 24 of frame head 22, allowing damper outside surface 32 to interfit within inner surface 23 of frame head 22. Projections 36 on damper membrane 30 are shaped and placed to correspond to apertures 46 in string head 42 and depressions 28 in frame head 22, as can be seen in FIGS. 3 and 4. Inside surface 38 possesses a plurality of reciprocal depressions 40 that are contoured and located opposite projections 36 on outside surface 32, as can be seen in FIGS. 2 and 3. The projections 36 and depressions 40 are for the interfitting of securing means pin 50.

The securing means, here pin 50, possesses smooth portion 54 and threaded portion 52. Smooth portion 54 is for fitting in reciprocal depression 40 of damper membrane, as can be seen in FIG. 4. Threaded portion 52 of pin 50 is for securing in threads 48 of aperture 46 of string head 42, as can best be seen in FIG. 4.

In use, frame head 22 receives both string head 42 and damper membrane 30. Damper membrane 30 is correspondingly shaped to interfit frame head 22, and damper membrane 30 is shaped with complimentary symmetry, such that it interfits between string head 42 and frame head 22. In another embodiment of this invention, string head 42 can be shaped to interfit frame head 22 without the inclusion of damper membrane 30. Frame 12 can be made out of any number of materials including, but not limited to, high modulus graphite, Kevlar TM, fiberglass, aluminum, carbon/visco polymer and liquid crystal polymer.

Damper membrane 30 fits in frame head 22 as can best be seen in FIG. 4, and receives string head 42 on inside surface 38 and the three elements are aligned such that depressions 28 of frame head 22 are aligned with projections 36 of damper membrane 30 and apertures 46 of string head 42, as can be seen in FIGS. 2, 3 and 4. Damper membrane 30 can be made out of various shock absorbing materials, depending on the tension and type of strings in string head 42 and amount of shock absorption or other functions desired of damper membrane 30.

String head 42 interfits within frame head 22 in contact with damper membrane 30, such that depressions 28 of frame head 22 are aligned with projections 36 of damper membrane 30 and apertures 46 of string head 42. String head 42 can be composed of any suitable materials similar to those described for frame 12 and can optionally be strung at much higher tensions because of the improved control of racquet 10. In the preferred embodiment securing means 50 is a pin, but can be any appropriate securing device, such as a clip, pin, peg or bolt, and can be secured by any appropriate securing means, such as threaded, squeeze compression, bayonet lock or other means. Smooth portion 54 of securing pin 50 rests in reciprocal depression 40 of inside surface of damper membrane 30, thereby holding projection 36 of damper membrane 30 in depression 28 in channel 24 of frame 12.

It should be noted that damper membrane 30 could be formed of an identical material as racquet 10, formed integral with racquet head 22, or eliminated entirely.

While there is shown and described the present preferred embodiment of the invention, it is to be distinctly understood that this invention is not limited thereto but may be variously embodied to practice within the scope of the following claims.

I claim:

1. A sports racquet comprising:

(a) a frame having a handle and a generally hoop-shaped head possessing an inner surface and an outer surface, wherein the inner surface of the frame head contains a channel contoured to receive the outside surface of a damper membrane, and the channel contains a plurality of depressions for receiving a securing means wherein the depressions are disposed around the perimeter of the frame head;

(b) a removable string head, correspondingly shaped to interfit the frame head and having holes therethrough disposed about the perimeter for forming a high tension grid of strings; and a plurality of securing means apertures for receiving a securing means, wherein the apertures are disposed around the perimeter of the string head positioned to correspond to the frame head depressions;

(c) a damper membrane having an inner surface and outer surface and shaped for interfitting between the string head and the frame head, wherein the outside surface of the damper membrane possesses:

(1) an elevated strip shaped for interfitting the outside surface of the damper membrane to the inside surface of the frame head; and (2) a plurality of projections for receiving a securing means, wherein the projections are shaped and placed to correspond to the securing means apertures in the string head and the frame head depressions; and (3) a plurality of reciprocal depressions on the inside surface that are contoured and located opposite the projections on the outside surface.

2. A sports racquet comprising:

(a) a frame having a handle and a generally hoop-shaped head possessing an inner surface and an outer surface, (b) a removable string head, correspondingly shaped to interfit the frame head and having holes therethrough disposed about the perimeter for forming a high tension grid of strings;

(c) an elevated strip shaped for interfitting the outside surface of the damper membrane with the inside surface of the frame head; and (d) a plurality of projections for receiving a securing means wherein the projections are shaped and placed to correspond to securing means apertures in the string head and frame head depressions; and (e) a plurality of reciprocal depressions on the inside surface that are contoured and located opposite the projections on the outside surface.

3. A sports racquet comprising:

(a) a frame having a handle and a generally hoop-shaped head possessing an inner surface and an outer surface, (b) a removable string head, correspondingly shaped to interfit the frame head and having holes therethrough disposed about the perimeter for forming a high tension grid of strings;

(c) a removable securing means for keeping a damper membrane and string head in a fixed orientation within the frame head;

(d) an elevated strip shaped for interfitting the outside surface of the damper membrane with the inside surface of the frame head; and (e) a plurality of projections for receiving a securing means wherein the projections are shaped and placed to correspond to securing means apertures in the string head and frame head depressions; and (f) a plurality of reciprocal depressions on the inside surface that are contoured and located opposite the projections on the outside surface.

4. A sports racquet comprising:

(a) a frame having a handle and a generally hoop-shaped head possessing an inner surface and an outer surface, wherein the inner surface of the frame head contains a channel;

(b) a removable string head, correspondingly shaped to interfit the frame head and having holes therethrough disposed about the perimeter for forming a high tension grid of strings;

(c) a removable securing means for keeping a damper membrane and string head in a fixed orientation within the frame head;

(d) an elevated strip shaped for interfitting the outside surface of the damper membrane with the inside surface of the frame head; and (e) a plurality of projections for receiving a securing means wherein the projections are shaped and placed to correspond to securing means apertures in the string head and frame head depressions; and (f) a plurality of reciprocal depressions on the inside surface that are contoured and located opposite the projections on the outside surface.

5. A sports racquet comprising:

(a) a frame having a handle and a generally hoop-shaped head possessing an inner surface and an outer surface, wherein the inner surface of the frame head contains a channel contoured to receive the outside surface of a damper membrane, and the channel contains a plurality of depressions for receiving a securing means wherein the depressions are disposed around the perimeter of the frame head;

(b) a removable string head, correspondingly shaped to interfit the frame head and having holes therethrough disposed about the perimeter for forming a high tension grid of strings;

(c) a removable securing means for keeping the damper membrane and string head in a fixed orientation within the frame head;

(d) an elevated strip shaped for interfitting the outside surface of the damper membrane with the inside surface of the frame head; and (e) a plurality of projections for receiving a securing means wherein the projections are shaped and placed to correspond to securing means apertures in the string head and the frame head depressions; and (f) a plurality of reciprocal depressions on the inside surface that are contoured and located opposite the projections on the outside surface.

6. A sports racquet comprising:

(a) a frame having a handle and a generally hoop-shaped head, the frame head possesses an inner surface, and an outer surface, the inner surface of the frame head contains a channel; the channel contains a plurality of depressions for receiving a securing means spaced around the circumference of the frame head and the channel is contoured to receive the outside surface of a damper membrane;

(b) a string head correspondingly shaped to interfit within the frame head, the string head possessing a plurality of string holes therethrough, disposed about the perimeter of the string head for forming a high tension grid of strings; and a plurality of securing means apertures for receiving a securing means, wherein the apertures are disposed around the perimeter of the string head positioned to correspond to the frame head depressions; and a damper membrane having an inner surface and outer surface and shaped for interfitting between the string head and the frame head, the damper membrane possessing an elevated strip shaped for interfitting the outside surface of the damper membrane to interfit within the inside surface of the frame head; and a plurality of projections for receiving a securing means, wherein the projections are shaped and placed to correspond to the securing means apertures in the string head and the frame head depressions; and a securing means for keeping the damper membrane and string head in a fixed orientation within the frame head.

7. The sports racquet of claim 6 wherein the securing means is a pin with a threaded portion and a smooth portion having a diameter allowing the pin to fit in threads of the apertures of the string head and the reciprocal depressions of the damper membrane.

* * * * *